US012760955B2

(12) United States Patent
Elmore et al.

(10) Patent No.: US 12,760,955 B2
(45) Date of Patent: Oct. 13, 2026

(54) AIRFLOW SYSTEM AND METHOD FOR TEMPERATURE CONTROL IN INTEGRATED COMPARTMENTS IN A REFRIGERATION APPLIANCE

(71) Applicant: BSH Hausgeräte GmbH, Munich (DE)

(72) Inventors: Morgan Elmore, Knoxville, TN (US); Eser Velisan, Muratli (TR); Jose Alberto Rodriguez Chavez, Oak Ridge, TN (US); Gürcan Durmaz, Tekirdag (TR); Necati Bora Gürel, Augsburg (DE); Kaan Erarslan, Tekirdag (TR)

(73) Assignee: BSH Hausgeräte GmbH, Munich (DE)

( * ) Notice: Subject to any disclaimer, the term of this patent is extended or adjusted under 35 U.S.C. 154(b) by 224 days.

(21) Appl. No.: 18/496,009

(22) Filed: Oct. 27, 2023

(65) Prior Publication Data

US 2024/0142159 A1 May 2, 2024

(30) Foreign Application Priority Data

Oct. 27, 2022 (TR) ..... 2022/016327

(51) Int. Cl.
*F25D 17/08* (2006.01)
*F25D 17/04* (2006.01)
*F25D 17/06* (2006.01)

(52) U.S. Cl.
CPC ..... *F25D 17/08* (2013.01); *F25D 17/045* (2013.01); *F25D 17/065* (2013.01); *F25D 2700/121* (2013.01)

(58) Field of Classification Search
CPC ..... F25D 17/045; F25D 17/065; F25D 17/08; F25D 2700/121
See application file for complete search history.

(56) References Cited

U.S. PATENT DOCUMENTS 6,351,967 B1 * 3/2002 Adachi ..... F25D 25/025 62/407
6,772,601 B1 8/2004 Davis et al.

FOREIGN PATENT DOCUMENTS

EP 2386812 A2 11/2011

* cited by examiner

*Primary Examiner* — Jonathan Bradford
(74) *Attorney, Agent, or Firm* — Laurence A. Greenberg; Werner H. Stemer; Ralph E. Locher

(57) ABSTRACT

An airflow system has an evaporator positioned in a first compartment of a refrigeration appliance and a damper. The airflow system includes a first supply duct that can be coupled to the first compartment and a second compartment and can direct air to the second compartment. A flap of the damper can be controlled based on a temperature setting of the second compartment. A second supply duct can be coupled to the first compartment and a third compartment and can direct air to the third compartment. A first return duct can be coupled to the first compartment and the second compartment and can direct air from the second compartment to the evaporator. Additionally, a second return duct can be coupled to the first compartment and the third compartment and can direct air from the third compartment to the evaporator.

13 Claims, 9 Drawing Sheets

AIRFLOW SYSTEM AND METHOD FOR TEMPERATURE CONTROL IN INTEGRATED COMPARTMENTS IN A REFRIGERATION APPLIANCE

CROSS-REFERENCE TO RELATED APPLICATION

This application claims the priority, under 35 U.S.C. § 119, of Turkish Patent Application TR 2022/016327, filed Oct. 27, 2022; the prior application is herewith incorporated by reference in its entirety.

FIELD AND BACKGROUND OF THE INVENTION

The present disclosure relates generally to refrigeration systems and, more particularly (although not necessarily exclusively), to an airflow system for controlling temperature in integrated compartments in a refrigeration appliance.

Refrigeration systems can include an evaporator and a compressor. The compressor can pump refrigerant through the refrigeration system. For example, a signal from a sensor can indicate that a temperature of the refrigeration system is above a set temperature. In response, the compressor can turn on to pump the refrigerant to facilitate cooling of the refrigeration system. Additionally, the refrigerant pumped by the compressor can pass through the evaporator to cool a surface of the evaporator. Thus, the evaporator can facilitate cooling of air within the refrigeration system. In some examples, the refrigeration system can include one or more compartments and the air cooled by the evaporator can be distributed to the one or more compartments to cool the one or more compartments. A user may set temperatures of the one or more compartments and the evaporator, compressor, and other suitable components can be used to generate the temperatures. Different temperatures for different compartments can be desirable to optimize preservation of fruits, vegetables, or other perishables.

SUMMARY OF THE INVENTION

It is accordingly an object of the invention to provide an airflow system for temperature control in integrated compartments in a refrigeration appliance that overcome the above-mentioned disadvantages of the prior art devices and methods of this general type.

With the foregoing and other objects in view there is provided, in accordance with the invention, an airflow system. The airflow system contains an evaporator for positioning in a first compartment of a refrigeration appliance, the evaporator being configured to decrease a temperature of air in the first compartment. A first supply duct is configured for coupling to the first compartment and a second compartment, and is configured to direct a first air flow from the first compartment to the second compartment. A damper having a flap is provided, and the flap is configured to be positioned based on a temperature setting of the second compartment. A second supply duct is configured for coupling to the first compartment and a third compartment and is configured to direct a second air flow from the first compartment to the third compartment. A first return duct is configured for coupling to the first compartment and the second compartment and is configured to direct a third air flow from the second compartment to the evaporator. A second return duct is configured for coupling to the first compartment and the third compartment and configured to direct a fourth air flow from the third compartment to the evaporator.

In accordance with an added feature of the invention, there is further provided a housing having a first geometry extending into a first opening of the first supply duct, wherein the housing is configured to receive air. A fan is provided and configured for positioning in the housing and to distribute the first air flow through the first geometry to the damper positioned in the first opening of the first supply duct. The flap is configured for being in an open position or a closed position, wherein the open position corresponds to the damper directing the first air flow to the second compartment via the first supply duct, and the closed position corresponds to the damper obstructing the first supply duct.

In accordance with an additional features of the invention, a mainboard is configured to provide a plurality of temperature settings for the second compartment, wherein the mainboard is configured to receive a setting of a plurality of temperature settings from a user. The temperature settings include temperatures ranging from −18 degrees celsius to 4 degrees celsius.

In accordance with a further feature of the invention, a sensor is communicatively coupled to a fan and the damper. The sensor is configured to measure a first temperature of the second compartment, and the setting is a second temperature of the second compartment. The mainboard is configured to provide an indication of a speed of the fan and a position of the flap based on a difference between the first temperature and the second temperature.

In accordance with another feature of the invention, at least one inner liner panel is provided. The first supply duct, the second supply duct, the first return duct, and the second return duct are configured to be fastened to the at least one inner liner panel. The at least one inner liner panel is configured to be positioned on a first backside of the first compartment, a second backside of the second compartment, and a third backside of the third compartment.

In accordance with a further added feature of the invention, foam is provided and configured for positioning proximate to the first supply duct, the second supply duct, the first return duct, and the second return duct. The foam is further configured to be positioned between the at least one inner liner panel and the outer liner panel.

In accordance with yet another feature of the invention, the first supply duct, the second supply duct, the first return duct, and the second return duct further contain a plurality of reinforcement components.

With the foregoing and other objects in view there is provided, in accordance with the invention, a method containing the steps of: providing a first air flow that is cooled by an evaporator positioned in a first compartment of a refrigeration appliance, and controlling, via an airflow system, a temperature of a second compartment by the further substeps of: receiving, via a mainboard, a temperature setting for the second compartment; receiving, via the mainboard, a measured temperature detected by a sensor of the second compartment; controlling, by the mainboard, a flap of a damper positioned in a first supply duct based on a difference between the temperature setting and the measured temperature; directing, by the first supply duct coupled to the first compartment and the second compartment, the first air flow from the first compartment to the second compartment; and directing, by a first return duct coupled to the first compartment and the second compartment, a second air flow from the second compartment to the evaporator.

Other features which are considered as characteristic for the invention are set forth in the appended claims.

Although the invention is illustrated and described herein as embodied in an airflow system for temperature control in integrated compartments in a refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
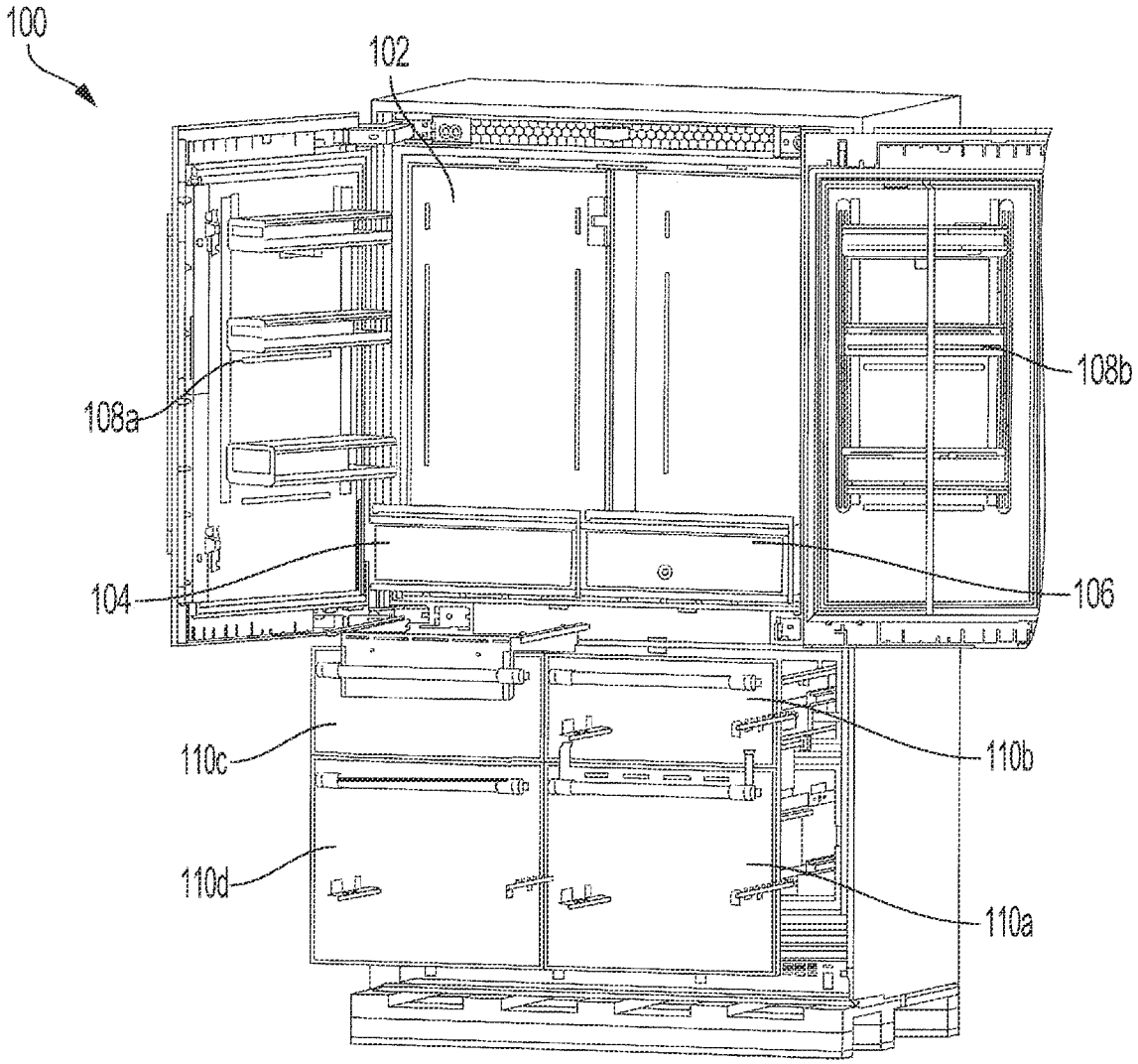
FIG. 1 is a schematic, front perspective view of a refrigeration appliance according to one example of the present disclosure.

Certain aspects and examples of the present disclosure relate to an airflow system for temperature control in a refrigeration appliance. The airflow system may be included in a refrigeration appliance such as a refrigerator, freezer, or other suitable refrigeration appliance. The refrigeration appliance may include one or more compartments in a body of the refrigeration appliance for storing food or other perishables. Additionally, the refrigeration appliance can include an evaporator that can have a cool surface for cooling air within the refrigeration appliance. The airflow system can include a fan and a damper for distributing and controlling airflow in the refrigeration appliance. By distributing and controlling the airflow in the refrigeration appliance, the airflow system can control the temperature of the refrigeration appliance, the compartments of the refrigeration appliance, or a combination thereof. Additionally, the airflow system can distribute air evenly to provide a uniform temperature throughout a full volume of the one or more compartments, the body of the refrigeration appliance, or a combination thereof.

Conventional refrigeration systems may not generate sufficient airflow or adequately control the airflow to cause significant changes in temperature to compartments in a refrigeration appliance. Additionally, conventional refrigeration systems may involve additional energy resources, fans, evaporators, etc. to effectively control airflow between compartments. Embodiments of the present disclosure provide a system with at least one supply duct and at least one return duct that can generate an efficient cycle of airflow between compartments in a refrigeration appliance. Therefore, the system can decrease the energy consumption and the noise level associated with cooling the refrigeration appliance. Additionally, the system can include different numbers of supply ducts and return ducts, different sizes of supply ducts and return ducts, or other suitable changes to supply duct and return duct configurations to provide a flexible airflow system that can be applied to refrigeration appliances of varying size, complexity, features, etc.

Additionally, different temperatures can be desirable for compartments of the refrigeration appliance, or temperatures of the compartments can change at different rates. For example, a user may change a temperature setting of a compartment from a first temperature associated with a refrigeration compartment to a second temperature associated with a freezer compartment. Therefore, the airflow system may direct airflow, create stronger airflow, or a combination thereof to provide a change in temperature from the first temperature to the second temperature in the compartment. Additionally, the compartments can include sensors for measuring temperatures of the compartments. Therefore, the airflow system may selectively direct airflow, block airflow, or create stronger airflow to the compartments of the refrigeration appliance via supply ducts and return ducts based on differences between measured temperatures of the compartments and set temperatures of the compartments.

In a particular example, a refrigeration appliance can include a freezer compartment, an icemaker compartment, and a flex compartment that can change between freezer temperatures and refrigeration temperatures. The airflow system can include a first fan positioned in a first housing for distributing first air. Additionally, a second fan can be positioned in a second housing for distributing second air. The first housing and second housing can be positioned in the freezer compartment proximate to an evaporator. The airflow system can include a first supply duct that can connect to the freezer compartment and the flex compartment. The airflow system can also include a second supply duct that can connect to the freezer compartment and the icemaker compartment. The first supply duct can direct a first air stream to the flex compartment. The second supply duct can direct a second air stream to the icemaker compartment. A damper with a flap can be positioned in the first supply duct. A position of the flap can be adjusted to control airflow to the flex compartment based on a temperature setting of the flex compartment. The airflow system can include a first return duct that can connect to the freezer compartment and the flex compartment. Additionally, a second return duct can connect to the freezer compartment and the icemaker compartment. The first return duct can direct a third air stream from the flex compartment to the evaporator. The second return duct can direct a fourth air stream from the icemaker compartment to the evaporator.

The evaporator can cool the third air stream and the fourth air stream for cycling the third air stream and the fourth air stream back into the freezer compartment, icemaker compartment, flex compartment, or a combination thereof. In some examples, the first air stream and the second air stream can be cooler than the third air stream and the fourth air stream.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Referring now to the figures of the drawings in detail and first, particularly to FIG. 1 thereof, there is shown a schematic of a front view of a refrigeration appliance 100 according to one example of the present disclosure. The refrigeration appliance 100 may be a refrigerator that can include a refrigeration compartment 102, a first drawer 104, a second drawer 106. Additionally, a first door 108*a* and a second door 108*b* can be provided for the refrigeration compartment 102, the first drawer 104, and the second drawer 106. The refrigeration appliance 100 can further include compartments 110*a-d*. The compartments 110*a-d* can be integrated compartments with connected components for creating airflow between the compartments 110*a-d*. In an example, a first compartment 110*a* and a fourth compartment 110*d* can be freezer compartments, a third compartment 110*c* can be an icemaker, a second compartment 110*b* can be a flex compartment. The flex compartment can be a compartment that can be used as a refrigeration compartment or as a freezer compartment. The freezer compartments can be two different compartments divided by, for example, a division plate, or the freezer compartments can be one large compartment.

The airflow system can be used for controlling temperature in the one or more compartments 110*a-d*. The airflow system can be placed in an interior of the refrigeration appliance 100. In some examples, the airflow system can be positioned horizontally in the first compartment 110*a*, the fourth compartment 110*d*, or a combination thereof. Additionally, the airflow system can be placed toward a back-side of the refrigeration appliance 100 proximate to an evaporator. In other examples, the airflow system can be positioned at other locations in the refrigeration appliance 100 or positioned vertically at a different angle relative to an axis of the refrigeration appliance 100.

Figure 2:
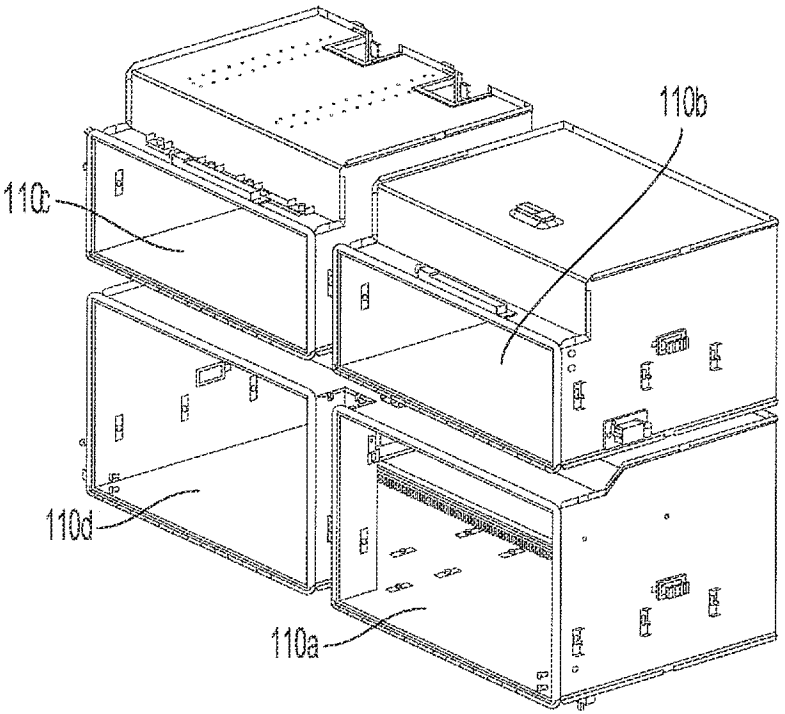
FIG. 2 is a schematic, front perspective view of compartments that can include an airflow system according to one example of the present disclosure.

FIG. 2 is a schematic of a front view of compartments 110*a-d* that can include an airflow system according to one example of the present disclosure. The compartments 110*a-d* can be freezer compartments, refrigeration compartments, crisper drawers, ice makers, or other suitable compartments associated with refrigeration appliances. In an example, a first compartment 110*a* and a fourth compartment 110*d* can be freezer compartments. A second compartment 110*b* can be a flex compartment for which a user can set a temperature. Additionally, a third compartment 110*c* can be an icemaker compartment that may have a same or similar temperature as the freezer compartments.

As the flex compartment, the second compartment 110*b* can be set to a range of temperatures. For example, the second compartment 110*b* can be set to a temperature between zero and negative eighteen degrees Celsius, during which the second compartment 110*b* can be used as a freezer compartment. Additionally, the second compartment 110*b* can be set to a temperature between zero and four degrees Celsius, during which the second compartment 110*b* can be used as a refrigeration compartment. A temperature setting of the second compartment 110*b* can be chosen by the user via a setting button. A mainboard can be in communication with the setting button to receive the temperature setting or other suitable setting for the second compartment 110*b*. Additionally, a measured temperature of the second compartment 110*b* can be monitored by a sensor, such as a thermistor or other suitable sensor, positioned in the second compartment 110*b*. The mainboard can receive the measured temperature from the sensor. The mainboard may further control a damper, a fan, or other component of the airflow system based on a different between the temperature setting and the measured temperature.

Additionally, in some examples, the first compartment 110*a* and the fourth compartment 110*d* can include separate openings for a user to access the first compartment 110*a* or the fourth compartment 110*d*. An inside of the first compartment 110*a* and the fourth compartment 110*d* can be connected to create a single compartment. In some examples, the inside of the first compartment 110*a* and the fourth compartment 110*d* can be separated by a division plate or other suitable component. The single compartment provided by the first compartment 110*a* and the fourth compartment 110*d* can be a freezer compartment. In some examples, cooling of the second compartment 110*b* and cooling of the third compartment 110*c* can depend on the first compartment 110*a*, the fourth compartment 110*d*, or a combination thereof.

The airflow system can be at least partially positioned in the first compartment 110*a*, the fourth compartment 110*d*, or a combination thereof. Additionally, the airflow system can be at least partially positioned proximate to an evaporator in the first compartment 110*a*, the fourth compartment 110*d*, or a combination thereof. The evaporator can be a device with a cool surface for cooling air from the compartments 110*a-d*. The airflow system can control the cooling of the second compartment 110*b* by directing the air cooled by the evaporator via a first supply duct to the second compartment 110*b*. The airflow system can also control the cooling of the third compartment 110*c* by directing the air cooled by the evaporator via a second supply duct to the third compartment 110*c*. Additionally, a first return duct can cool the second compartment 110*b* by directing warm air from the second compartment 110*b* to the evaporator. A second return duct can cool the third compartment 110*c* by directing warm air from the third compartment 110*c* to the evaporator.

Figure 3:
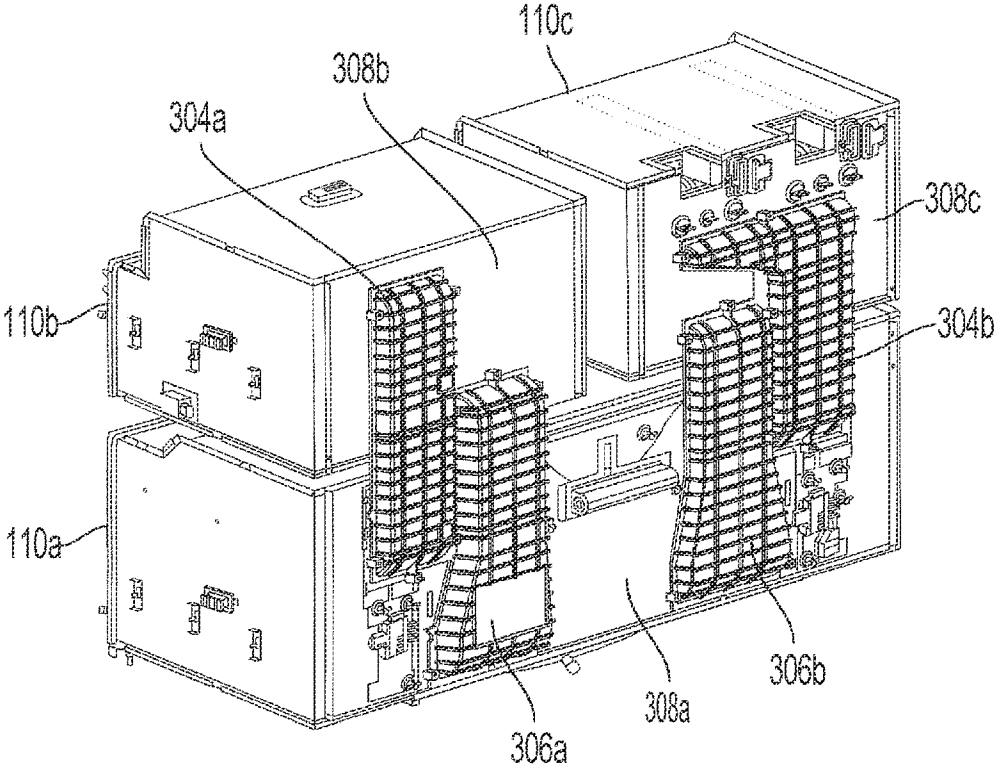
FIG. 3 is a schematic, rear perspective view of compartments that can include the airflow system according to one example of the present disclosure.

FIG. 3 is a schematic of a back view of the first compartment 110*a*, the second compartment 110*b* and the third compartment 110*c* that can include an airflow system according to one example of the present disclosure. The first compartment 110*a*, the second compartment 110*b* and the third compartment 110*c* can be freezer compartments, refrigeration compartments, crisper drawers, ice makers, or other suitable compartments associated with refrigeration appliances. In an example, a first compartment 110*a* can be a freezer compartment and a second compartment 110*b* can be a flex compartment. Additionally, a third compartment 110*c* can be an icemaker compartment. In some examples, the freezer compartment and the icemaker compartment can be set to a same or similar temperature. For example, the temperature of the freezer compartment and the icemaker compartment can be negative eighteen degrees. The flex compartment may also be set to the same or similar temperature as the freezer compartment and icemaker compartment, or the flex compartment may be set to a different temperature than the freezer compartment and icemaker compartment.

The first compartment 110*a*, the second compartment 110*b* and the third compartment 110*c* can be coupled with one or more supply ducts and one or more return ducts. As illustrated a first supply duct 304*a* can be coupled to a first backside 308*a* of the first compartment 110*a* and a second backside 308*b* of the second compartment 110*b*. A second supply duct 304*b* can be coupled to the first backside 308*a* of the first compartment 110*a* and a third backside 308*c* the third compartment 110*c*. A first return duct 306*a* can be coupled to the first backside 308*a* of the first compartment 110*a* and the second backside 308*b* of the second compartment 110*b*. Additionally, a second return duct 306*b* can be coupled to the first backside 308*a* of the first compartment 110*a* and the third backside 308*c* of the third compartment 110*c*.

In some examples, air can be directed between the first compartment 110*a*, the second compartment 110*b* and the third compartment 110*c* via the supply ducts 304*a-b* and the return ducts 306*a-b*. For example, air can be directed from the first compartment 110*a* to the second compartment 110*b* via the first supply duct 304*a*. Air can be directed from the first compartment 110*a* to the third compartment 110*c* via the second supply duct 304*b*. Additionally, air can be directed from the second compartment 110*b* to the first compartment 110*a* via the first return duct 306*a*. Air can further be directed from the third compartment 110*c* to the first compartment 110*a* via the second return duct 306*b*. The air directed by the return ducts 306*a-b* can be warmer than the air directed by the supply ducts 304*a-b*. Thus, the airflow system can maintain the temperatures of the first compartment 110*a*, the second compartment 110*b* and the third compartment 110*c* by providing cool air from the first compartment 110*a* to the second compartment 110*b* and third compartment 110*c* via supply ducts 304*a-b* and by removing warm air from compartments 310*b-c* via return ducts 306*a-b*.

The airflow system may also include a first housing and a second housing positioned inside the first compartment 110*a*. The first housing and the second housing can further be positioned proximate to an evaporator in the first compartment 110*a*. In an example, the evaporator is on a bottom side of the first compartment 110*a*. A first fan can be positioned in the first housing for distributing air cooled by the evaporator to the second compartment 110*b* via the first supply duct 304*a*. A second fan can also be positioned in the second housing for distributing air cooled by the evaporator to the third compartment 110*c* via the second supply duct 304*b*.

In some examples, the airflow system may not include housings or can include a different number of housings. Additionally, a damper can be positioned in, for example, the first housing. The damper may also be positioned in a supply duct, such as the first supply duct 304*a*. The damper can have a flap that can open and close. The flap may be positionable in a closed position to block airflow and may be positionable in an open position to allow airflow. Thus, a damper can further be used in the airflow system to control airflow to the first compartment 110*a*, second compartment 110*b* and third compartment 110*c*.

Figure 4:
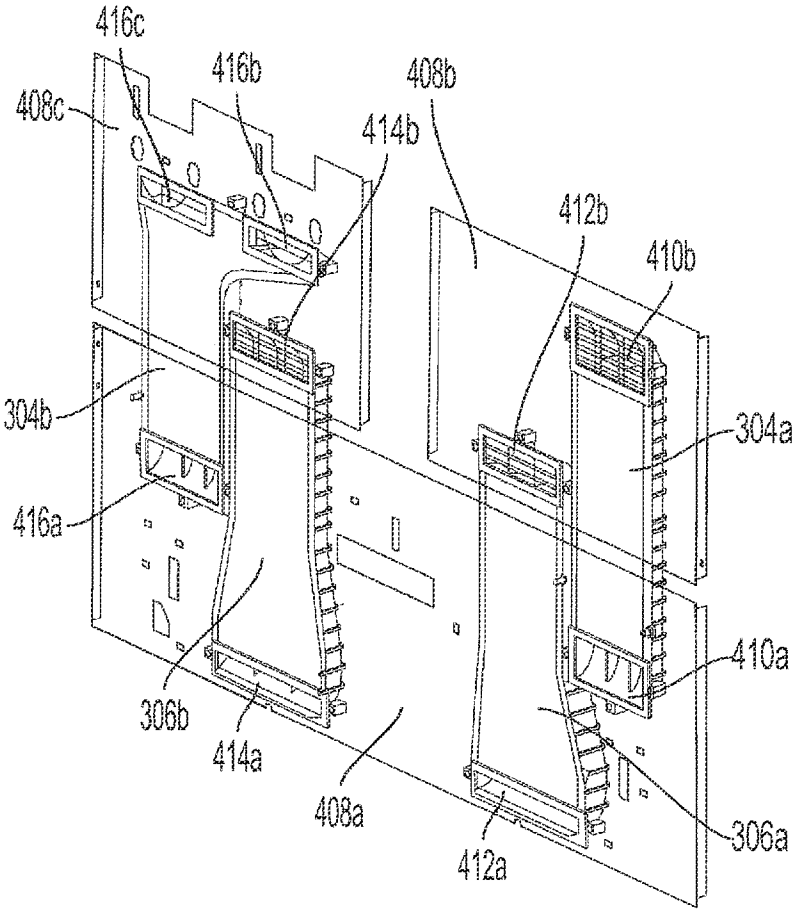
FIG. 4 is a schematic, front perspective view of supply ducts and return ducts that can be included in the airflow system for compartments according to one example of the present disclosure.

FIG. 4 is a schematic of a front view of supply ducts 304*a-b* and return ducts 306*a-b* that can be included in an airflow system for compartments 110*a-d* according to one example of the present disclosure. A first supply duct 304*a* can include a first opening of the first supply duct 410*a* and a second opening of the first supply duct 410*b*. In an example, the first supply duct 304*a* can be coupled to a first inner liner panel 408*a* and a second inner liner panel 408*b*. Inner liner panels 408*a-c* can be positioned on a backside of the first compartment 110*a*, second compartment 110*b* and third compartment 110*c* in a refrigeration appliance. Therefore, air can be directed from a first compartment associated with the first opening of the first supply duct 410*a* to a second compartment associated with the second opening of the first supply duct 410*b* via the first supply duct 304*a*.

A second supply duct 304*b* can include a first opening of the second supply duct 416*a*, a second opening of the second supply duct 416*b*, and a third opening of the second supply duct 416*c*. The second supply duct 404*b* can be coupled to the first inner liner panel 408*a* and a third inner liner panel 408*c*. In an example, air can be directed from the first compartment to a third compartment via the second supply duct 304*b*. The first opening of the second supply duct 416*a* can be associated with the first compartment and the second opening of the second supply duct 416*b* and the third opening of the second supply duct 416*c* can be associated with the third compartment.

Additionally, a first return duct 306*a* can be coupled to the first inner liner panel 408*a* and the second inner liner panel 408*b*. The first return duct 306*a* include a first opening of the first return duct 412*a* that can be associated with the first compartment and a second opening of the first return duct 412*b* that can be associated with the second compartment. Air can be directed, via the first return duct 306*a*, from second compartment to the first compartment.

A second return duct 306*b* can be coupled to the first inner liner panel 408*a* and the third inner liner panel 408*c*. The second return duct 406*b* can include a first opening of the second return duct 414*a* and a second opening of the second return duct 414*b*. In an example, the first opening of the second return duct 414*a* can also be associated with the first compartment and the second opening of the second return duct 414*b* can be associated with the third compartment. Air can be directed from the third compartment to the first compartment via the second return duct 306*b*.

In some examples, the air directed through the return ducts 306*a-b* can be warmer than air directed through the supply ducts 304*a-b*. The air directed by the return ducts 306*a-b* can be directed to an evaporator in the refrigeration appliance. Additionally, air directed to compartments in the refrigeration appliance by supply ducts 304*a-b* can be cooled by the evaporator. The air cooled by the evaporator can be distributed by one or more fans of the airflow system. Thus, the evaporator can provide cool air for the refrigeration appliance, the fans can distribute the cool air to facilitate airflow through the supply ducts 304*a-b*, and warm air can be removed by the return ducts 306*a-b* to create an efficient airflow cycle.

Figure 5:
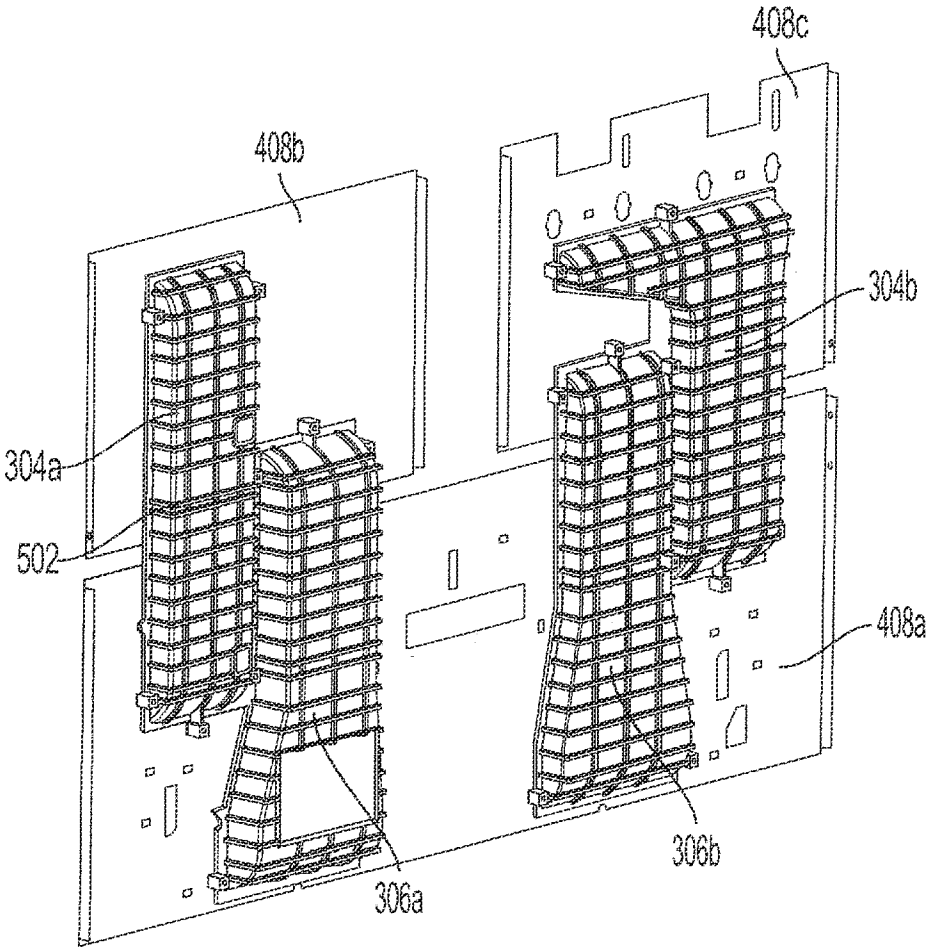
FIG. 5 is a schematic, rear perspective view of the supply ducts and the return ducts that can be included in the airflow system for compartments according to one example of the present disclosure.

FIG. 5 is a schematic of a back view of supply ducts 304*a-b* and return ducts 306*a-b* that can be included in an airflow system for compartments 110*a-d* according to one example of the present disclosure. As illustrated, the airflow system can include a first supply duct 304*a* that can be fastened or otherwise coupled to a first inner liner panel 408*a* and a second inner liner panel 408*b*. A second supply duct 304*b* can be fastened or otherwise coupled to the first inner liner panel 408*a* and a third inner liner panel 408*c*. Additionally, a first return duct 306*a* can be coupled to the first inner liner panel 408*a* and the second inner liner panel 408*b*. A second return duct 306*b* can also be coupled to the first inner liner panel 408*a* and the third inner liner panel 408*c*.

The inner liner panels 408*a-c* can be positioned on a backside of a refrigeration appliance. In some examples, foam can be injected around the supply ducts 304*a-b* and return ducts 306*a-b* for insulating the supply ducts 304*a-b* and the return ducts 306*a-b*. Additionally, an outer liner panel can be placed over the inner liner panels such that the supply ducts 304*a-b*, the return ducts 306*a-b*, and the foam are between the inner liner panels 408*a-c* and the outer liner panel.

The use of the supply ducts 304*a-b* and the return ducts 306*a-b* in the airflow system can increase available space in compartments of the refrigeration appliance. Additionally, the use of the supply ducts 304*a-b* and the return ducts 306*a-b* and can reduce the complexity and number of parts involved in providing sufficient airflow to compartments in the refrigeration appliance. The supply ducts 304*a-b* and the return ducts 306*a-b* can further include reinforcement components 502 to protect the supply ducts 304*a-b* and the return ducts 306*a-b* from potential damage. For example, the reinforcement components 502 can prevent the foam from causing indentations in the supply ducts 304*a-b* or return ducts 306*a-b*. Additionally, the supply ducts 304*a-b* and the return ducts 306*a-b* can be composed of a plastic shell, insulating materials, a sealing component, other suitable components or materials, or a combination thereof.

Figure 6:
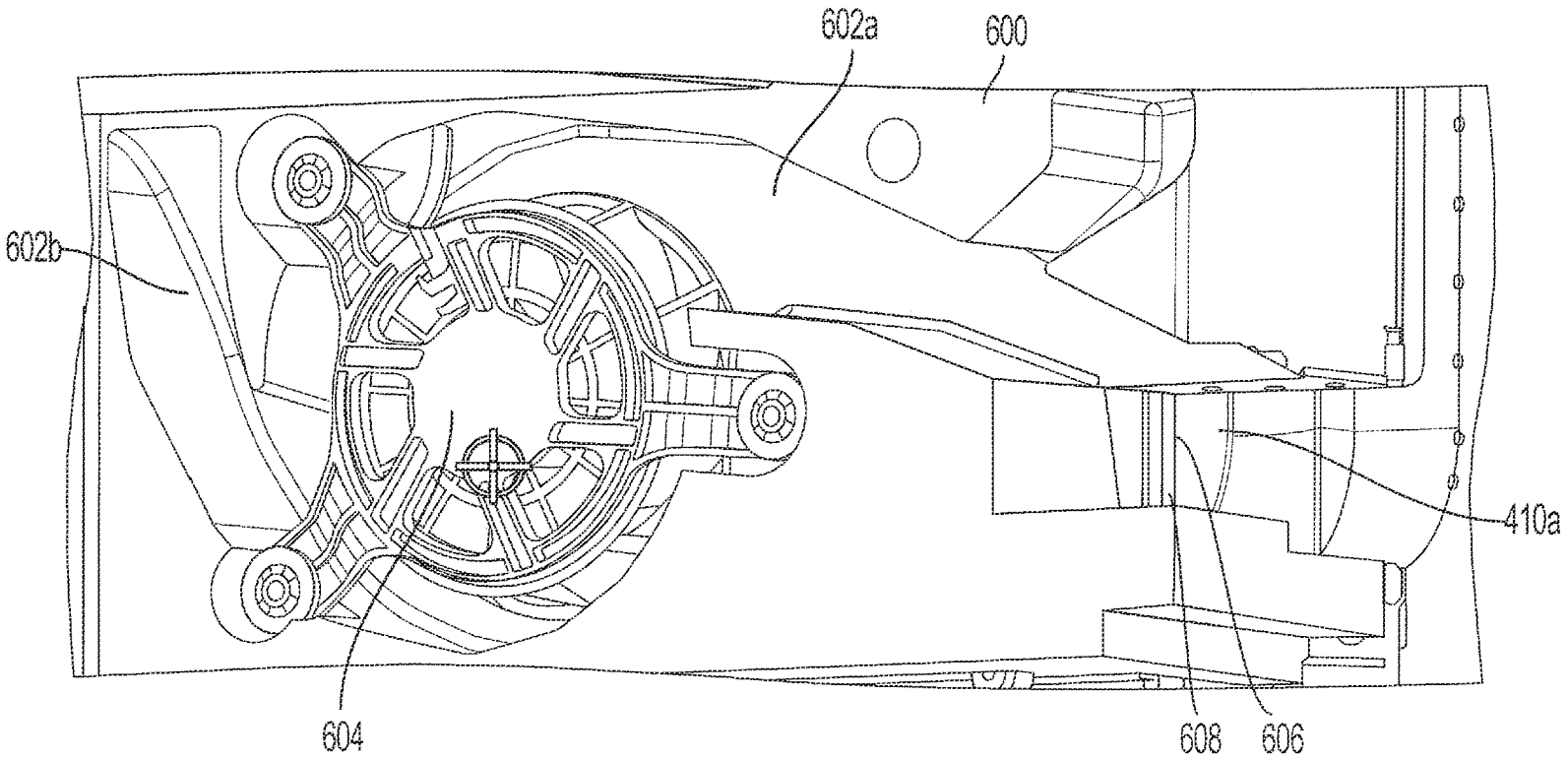
FIG. 6 is a perspective view of a housing that can be included in the airflow system according to one example of the present disclosure.

FIG. 6 is a schematic of a housing 600 that can be included an airflow system according to one example of the present disclosure. In some examples, the housing 600 can be positioned in a first compartment 110*a*. The housing 600 can include a first geometry 602*a* that can extend into a first opening of the first supply duct 410*a*. The housing 600 can further include a second geometry 602*b* defining a second opening that can extend into a first compartment 110*a*. Additionally, the housing can store a fan 604. The fan 604 can distribute air through the second geometry 602*b* to cool the first compartment 110*a* and distribute air through the first geometry 602*a* to the first supply duct 304*a*. The air can be directed through the first supply duct 304*a* to cool a second compartment 110*b*.

The housing 600 may include a damper 606 positioned in the first geometry 602*a*. In some examples, the damper 606 can be positioned in the first supply duct 304*a*. Additionally, the damper 606 may be positioned in the first opening of the first supply duct 410*a*. The damper 606 can include a flap 608 that can be in a closed position to prevent airflow through the first opening of the first supply duct 410*a* or the first geometry 602*a*. The flap 608 can also be in an open position to allow airflow to the first supply duct 304*a*. The flap 608 can open or closed based on a temperature of a second compartment 110*b*. For example, a mainboard can receive a measured temperature for the second compartment 110*b* from a sensor. The mainboard can further receive a set temperature for the second compartment 110*b*. The mainboard can control the flap 608 by causing the flap 608 to be in the open position or the closed position based a difference between the set temperature and the measured temperature. The mainboard may control the flap 608 by sending a signal to the damper 606. The mainboard may further control a speed of the fan 604 based on the difference between the set temperature and the measured temperature. The mainboard may also control the speed by sending a signal to the fan 604.

In an example, the housing 600 can be a first housing and the airflow system can further include a second housing positioned in the first compartment. A first fan can be positioned in the first housing and second fan can be positioned in the second housing. The first housing can include a first damper that can have two flaps. A first flap can be positioned in the first opening and a second flap can be positioned in the second opening. The first flap and the second flap can open and close independently to selectively direct air to the first compartment, the supply duct, or a combination thereof. The second housing can include a third geometry that can define a third opening that can extend into the first compartment and a fourth geometry that can define a fourth opening that can extend into a second supply duct. A second damper can be positioned in the second housing that can also have two flaps. A third flap can be positioned in the third opening and a fourth flap can be positioned in the fourth opening. The third flap and the fourth flap can also open and close independently of one another to selectively direct air to the first compartment, the second supply duct, or a combination thereof.

Additionally or alternatively, dampers with one flap can be used for each opening of the first housing and the second housing. Additionally, in some examples, a different number of fans or fans of different type, size, shape, etc. can be included in the first housing or the second housing. The airflow system may also include a different number of housings. The housings may be altered to include a different number of geometries, or the housings may be altered to include different or additional components. For example, the first fan, the second fan, the first damper, and the second damper can be positioned in a single housing. In other examples, the single housing can have a different number of fans or a different number of dampers. The single housing may further include different sizes or types of fans or different sizes or types of dampers.

Figure 7:
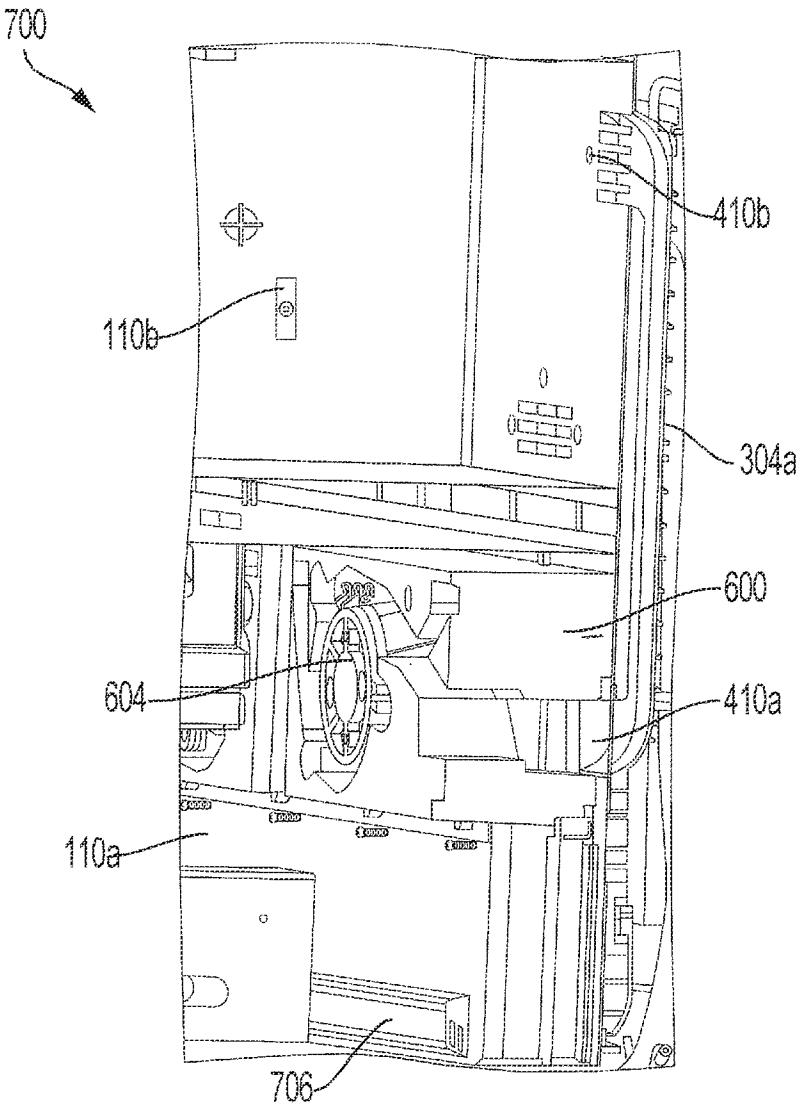
FIG. 7 is a schematic, perspective partial view of the airflow system in a refrigeration appliance according to one example of the present disclosure.

FIG. 7 is a schematic of a partial view of an airflow system 700 in a refrigeration appliance according to one example of the present disclosure. As illustrated, the refrigeration appliance can include a first compartment 110*a* positioned below a second compartment 110*b*. The first compartment 110*a* can include an evaporator 706 for cooling air in the refrigeration appliance. Additionally, the airflow system 700 can include a housing 600 that can be positioned in the first compartment 110*a*. In some examples, a fan 604 can be positioned in the housing 600. The housing 600 can include a first geometry 602*a* that can extend into a first supply duct 304*a* and a second geometry 602*b* that can extend into the first compartment 110*a*. The first supply duct 304*a* can have a first opening of the first supply duct 410*a* that can connect to the first geometry 602*a* of the housing 600. The first supply duct 304*a* can also have a second opening of the first supply duct 410*b* that can connect to the second compartment 110*b*. Therefore, air cooled by the evaporator 706 can be received by the airflow system 700 via the housing 600. The fan 604 can distribute the air in the housing 600. The air can be directed through the second geometry 602*b* to the first compartment 110*a* and the air can be directed through the first geometry 602*a* to the first supply duct 304*a*. The air can be directed through the first supply duct 304*a* to the second compartment 110*b* via the second opening of the first supply duct 410*b*. The air may decrease a temperature of the second compartment 110*b*.

In some examples, a damper can be positioned in the first geometry 602*a*, the first supply duct 304*a*, or the first opening of the first supply duct 410*a*. A flap of the damper can obstruct airflow to the second compartment 110*b* in a closed position or enable the airflow to the second compartment 110*b* in an open position. Additionally, the second compartment 110*b* can be a flex compartment that can be set to a range of temperatures. For example, the second compartment 704 can be set to a temperature between negative eighteen and four degrees Celsius. Therefore, the flap can be used to control airflow to the second compartment 110*b* to control the temperature of the second compartment 110*b*. A position of the flap can be based on a difference between a set temperature of the second compartment 110*b* and a temperature of the second compartment 110*b* detected by a sensor, such as a thermistor.

Figure 8:
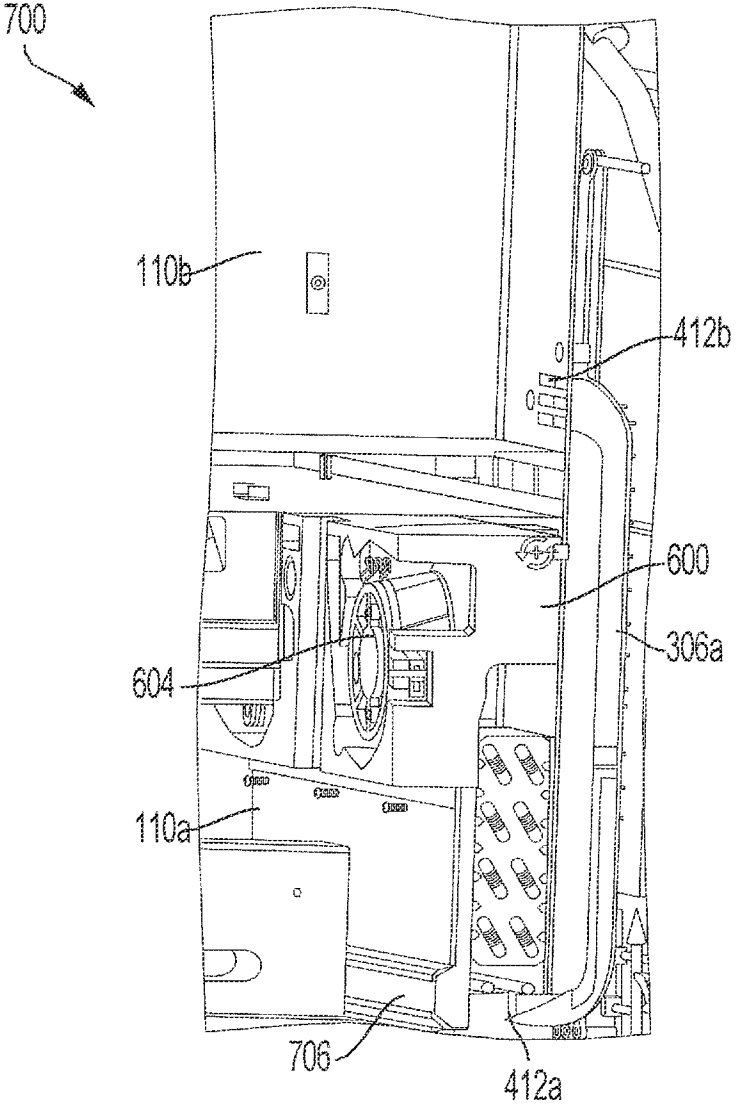
FIG. 8 is a schematic, perspective partial view of the airflow system in the refrigeration appliance according to one example of the present disclosure.

FIG. 8 is a schematic of a partial view of an airflow system 700 in a refrigeration appliance according to one example of the present disclosure. A first compartment 110*a* can include an evaporator 706 for cooling air in the refrigeration appliance. Additionally, the airflow system 700 can include a housing 600 that can store a fan 604 and a damper. The housing 600 can be positioned in the first compartment 110*a*. The airflow system 700 can further include a first return duct 306*a* that can have a first opening of the first return duct 412*a* that can connect to the first compartment 110*a* and a second opening of the first return duct 412*b* that can connect to a second compartment 110*b*. As illustrated, the first opening of the first return duct 412*a* can be positioned proximate to the evaporator 706 in the first compartment 110*a*. Therefore, air from the second compartment 110*b* can be directed to the evaporator 706 via the first return duct 306*a*. The air directed from the second compartment 110*b* to the evaporator 706 can be a higher temperature than the set temperature of the second compartment 110*b*. Therefore, the first return duct 306*a* can remove warm air from the second compartment 110*b*, while a first supply duct 304*a* provides cool air to maintain a set temperature of the second compartment 110*b*.

Figure 9:
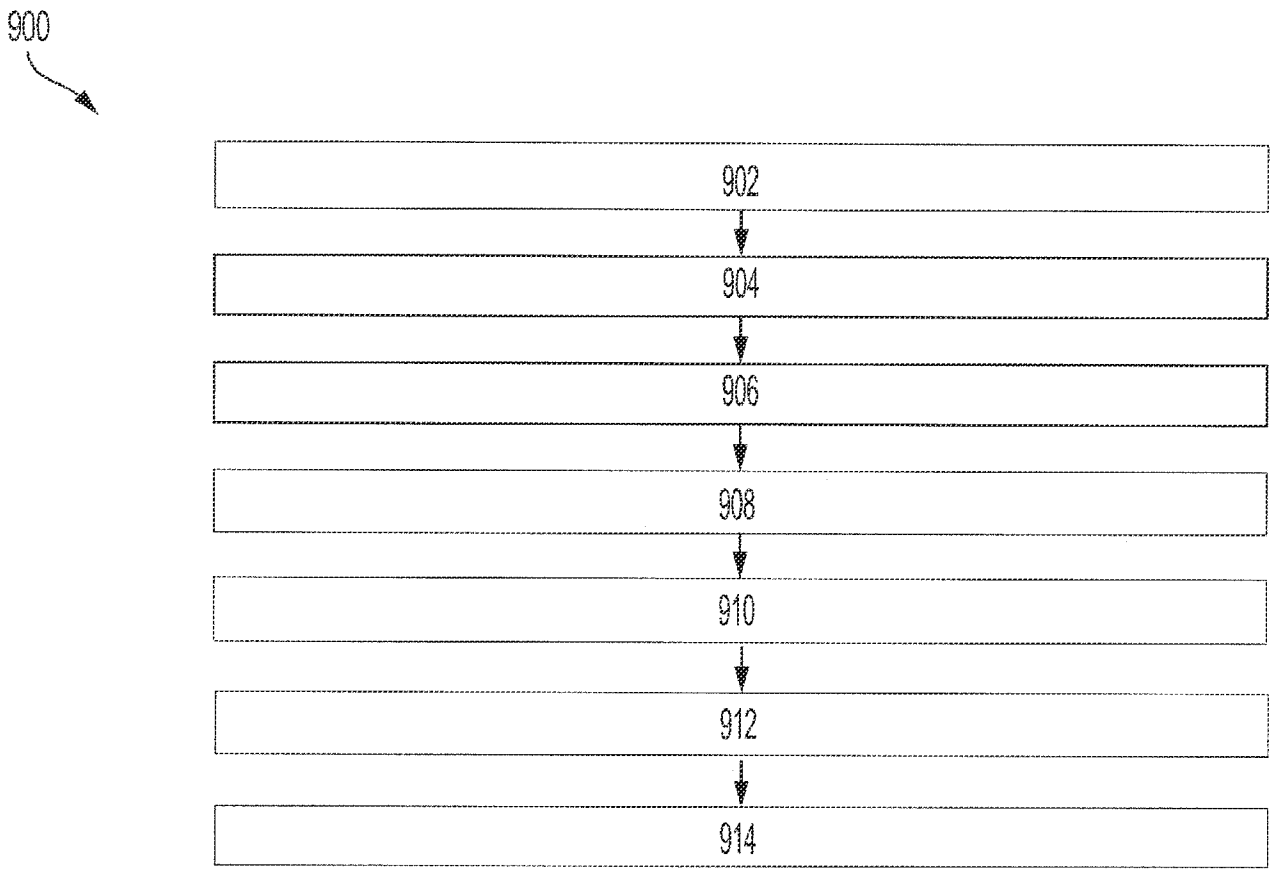
FIG. 9 is a flowchart of a process for controlling temperature in compartments in the refrigeration appliance using the airflow system.

FIG. 9 is a flowchart of a process for controlling temperature in compartments refrigeration appliance using an airflow system 700. Aspects of FIG. 9 are discussed with respect to the components in FIG. 3, FIG. 7, and FIG. 8. The refrigeration appliance can be a freezer, refrigerator, or other suitable refrigeration appliance. Controlling temperature in the compartments can involve the airflow system 700 providing sufficient airflow to the compartments to create a uniform temperature distribution in each of the compartments. The compartments can be integrated compartments that can include various components for distributing airflow between the compartments. Additionally, the compartments can vary in size, shape, type of compartment, etc. Therefore, the airflow system 700 can be a flexible solution for providing airflow that can be applied to the compartments of varying size, shape, etc.

At first block 902, the airflow system 700 can generate, via an evaporator 706 positioned in a first compartment 110*a* of the refrigeration appliance, first air, by cooling, via the evaporator 706, the first air. The evaporator 706 can be a device with a cool surface that can cool air in the refrigeration appliance. In some examples, the first compartment 110*a* can be a freezer compartment. Additionally, the evaporator 706 can be positioned in a bottom portion of the first compartment 110*a*, can be positioned in a back portion of the first compartment 110*a*, or can be located elsewhere in the first compartment 110*a*.

At second block 904, the airflow system 700 can control a temperature of a second compartment 110*b*. The second compartment 110*b* can be a flex compartment in which the temperature can change. The temperature change may change the purpose of the flex compartment. For example, the flex compartment can be used as a freezer compartment or a refrigeration compartment.

At third block 906, the airflow system 700 can receive, via a mainboard, a temperature setting for the second compartment 110*b*. In some examples, the mainboard can provide a plurality of temperature settings for the second compartment 110*b* to a user. For example, the plurality of temperature settings can range from negative eighteen degrees Celsius to four degrees Celsius. The user may choose the temperature setting out of the plurality of temperature settings. In examples, the plurality of temperature settings can be associated with intended use of the second compartment 110*b* by the user. For example, the temperature settings provided to the user can be crisper, freezer, refrigeration, etc.

At fourth block 908, the airflow system 700 can receive, via the mainboard, a measured temperature detected by a sensor for the second compartment 110*b*. The sensor can be a thermistor or other suitable sensor. In some examples, the mainboard can receive the measured temperature as a change in temperature of the second compartment 110*b* detected by the sensor or the mainboard can receive the measured temperature as the current temperature of the second compartment 704.

At fifth block 910, the airflow system 700 can control, by the mainboard, a flap of a damper based on a difference between the temperature setting and the measured temperature. The damper can be positioned in a first supply duct 304*a*, in a housing 600, in a first opening of the first supply duct 410*a* associated with the first supply duct 304*a*, or otherwise positioned in the airflow system 700. The flap of the damper can have an open position and a closed position. The mainboard can control the flap by sending a signal to the damper to cause the flap to move to the open position or the closed position. In an example, the measured temperature of the second compartment 110*b* can be higher than the temperature setting. Therefore, the mainboard can cause the flap to open to enable air to reach the first supply duct 304*a*. The mainboard can further cause the flap to close when the measured temperature decreases to the temperature setting. Additionally, there can be a threshold for which the measured temperature and the temperature setting can be different. For example, the threshold can be half of a degree Celsius. Therefore, for example, while the measured temperature is within a half of a degree Celsius of the temperature setting the mainboard can cause the flap to be in the closed position.

At sixth block 912 the airflow system 700 can direct, via the first supply duct 304*a* coupled to the first compartment 110*a* and the second compartment 110*b*, the first air flow from the first compartment 110*a* to the second compartment 110*b*. In an example, the first compartment 110*a* can be a freezer compartment and the second compartment 110*b* can be a full flex compartment. Additionally, the airflow system 700 can include the housing 600 that can be positioned in the first compartment 110*a* proximate to the evaporator 706. The housing 600 can have a first geometry 602*a* that can extend into the first supply duct 304*a*. The housing 600 can also have a second geometry 602*b* that can extend into the first compartment 110*a*. Therefore, the first air flow can have two airflow paths as provided by the housing 600. The first airflow path can be through the first geometry 602*a* and the first opening of the first supply duct 410*a* to the first supply duct 304*a*. The damper may enable or block the first airflow path via the flap. The second airflow path can be through the second geometry 602*b* to the first compartment 110*a*. A fan 604 can be positioned in the housing 600 for distributing air to the first airflow path and second airflow path. The mainboard may also control a speed of the fan 604 based on the difference between the temperature setting and the measured temperature.

At seventh block 914 the airflow system 700 can direct, via a first return duct 306*a* coupled to the first compartment

110*a* and the second compartment 110*b*, a second air flow from the second compartment 110*b* to the evaporator 706. The second air flow can be warmer than a temperature setting of the second compartment 110*b*. The second air flow may also be warmer than the first air flow. Therefore, the first return duct 306*a* can remove the second air flow from the second compartment 110*b* to cool the second compartment 110*b*. By providing the first air flow to the second compartment 110*b* via the first supply duct 304*a* and removing the second air flow from the second compartment 110*b* via the first return duct 306*a*, the airflow system 700 can create an efficient airflow cycle for controlling the temperature of the second compartment 110*b*.

Additionally or alternatively, process 900 can include, the airflow system 700 directing, via a second supply duct 304*b* coupled to the first compartment 110*a* and a third compartment 110*c*, third air from the first compartment 110*a* to the third compartment 110*c*. In an example, the third compartment 110*c* can be an icemaker compartment and the third compartment 110*c* may be a same or similar temperature as the first compartment 110*a*. The third air flow can also be cooled by the evaporator 706. Therefore, the temperatures of the second compartment 110*b* and the third compartment 110*c* can depend on the evaporator 706 in the first compartment 110*a*. The use of the supply ducts 304*a-b* can decrease the number of evaporators, fans, etc. used in the refrigeration appliance to provide cool air to various compartments. Additionally, the second compartment 110*b* can be a different temperature than the first compartment 110*a* and the third compartment 110*c* as the airflow system 700 can use the damper to control airflow to the second compartment 110*b*.

In some examples, the airflow system 700 can further include a second fan for distributing the third air flow. The second fan can be positioned in the housing 600 or positioned in a second housing. The second housing can have a third geometry that can define a third opening extending into the second supply duct. The second housing can also have a fourth geometry that can define a fourth opening extending into the first compartment 110*a*.

Additionally, the airflow system 700 can direct, via a second return duct coupled to the first compartment 110*a* and the third compartment 110*c*, the fourth air flow from the third compartment to the evaporator 706. The fourth air flow can be warmer than a temperature setting of the third compartment. Therefore, the second return duct can remove the fourth air flow from the third compartment to cool the third compartment. Additionally, by providing the third air flow to the third compartment via the second supply duct and removing the fourth air flow via the second return duct, the airflow system 700 can create an efficient airflow cycle for controlling the temperature of the third compartment.

In some examples, additional or fewer supply ducts or return ducts can be used to control the temperature of additional or fewer compartments. Additionally, a different number of housings, fans, or dampers can be implemented in a compartment with an evaporator to efficiently direct air to the supply ducts, compartments, or a combination thereof.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

The following is a summary list of reference numerals and the corresponding structure used in the above description of the invention:

100. Refrigeration appliance
102. Refrigeration compartment
104. First drawer
106. Second drawer
108*a*. First door
108*b*. Second door
110*a*. First compartment
110*b*. Second compartment
110*c*. Third compartment
110*d*. Fourth compartment
304*a*. First supply duct
304*b*. Second supply duct
306*a*. First return duct
306*b*. Second return duct
308*a*. First backside
308*b*. Second backside
308*c*. Third backside
408*a*. First inner liner panel
408*b*. Second inner liner panel
408*c*. Third inner liner panel
410*a*. First opening of the first supply duct
410*b*. Second opening of the first supply duct
412*a*. First opening of the first return duct
412*b*. Second opening of the first return duct
414*a*. First opening of the second return duct
414*b*. Second opening of the second return duct
416*a*. First opening of the second supply duct
416*b*. Second opening of the second supply duct
416*c*. Third opening of the second supply duct
502. Reinforcement components
600. Housing
602*a*. First geometry
602*b*. Second geometry
604. Fan
606. Damper
608. Flap
700. Airflow system
706. Evaporator
902. First block
904. Second block
906. Third block
908. Fourth block
910. Fifth block
912. Sixth block
914. Seventh block

The invention claimed is:

1. An airflow system, comprising:

an evaporator positioned directly in a first compartment of a refrigeration appliance, said evaporator configured to decrease a temperature of air in the first compartment;

a first supply duct configured for coupling to the first compartment and a second compartment and configured to direct a first air flow directly from the first compartment to the second compartment;

a damper having a flap, said flap configured to be positioned based on a temperature setting of the second compartment;

a second supply duct configured for coupling to the first compartment and a third compartment and configured to direct a second air flow from the first compartment to the third compartment;

a first return duct configured for coupling to the first compartment and the second compartment and configured to direct a third air flow from the second compartment to said evaporator;

a second return duct configured for coupling to the first compartment and the third compartment and configured to direct a fourth air flow from the third compartment to said evaporator; and at least one inner liner panel, said first supply duct, said second supply duct, said first return duct, and said second return duct being configured to be fastened to said at least one inner liner panel, and said at least one inner liner panel being configured to be positioned on a first backside of the first compartment, a second backside of the second compartment, and a third backside of the third compartment.

2. The airflow system according to claim 1, wherein said first supply duct having a first opening formed therein;

further comprising a housing having a first geometry extending into said first opening of said first supply duct, wherein said housing is configured to receive the air; and further comprising a fan configured for positioning in said housing and to distribute the first air flow through said first geometry to said damper positioned in said first opening of said first supply duct, wherein said flap is configured for being in an open position or a closed position, wherein the open position corresponds to said damper directing the first air flow to the second compartment via said first supply duct, and wherein the closed position corresponds to said damper obstructing said first supply duct.

3. The airflow system according to claim 1, further comprising a mainboard configured to provide a plurality of temperature settings for the second compartment, wherein said mainboard is configured to receive a setting of the plurality of temperature settings from a user.

4. The airflow system according to claim 3, wherein the temperature settings include temperatures ranging from −18 degrees celsius to 4 degrees celsius.

5. The airflow system according to claim 3, further comprising:

a fan; and a sensor communicatively coupled to said fan and said damper, wherein said sensor is configured to measure a first temperature of the second compartment, and wherein the setting is a second temperature of the second compartment, and wherein said mainboard is configured to provide an indication of a speed of said fan and a position of said flap based on a difference between the first temperature and the second temperature.

6. The airflow system according to claim 1, further comprising:

an outer liner panel; and foam configured for positioning proximate to said first supply duct, said second supply duct, said first return duct, and said second return duct, and said foam further configured to be positioned between said at least one inner liner panel and said outer liner panel.

7. The airflow system according to claim 1, wherein said first supply duct, said second supply duct, said first return duct, and said second return duct further contain a plurality of reinforcement components.

8. A method, comprising:

providing a first air flow that is cooled by an evaporator directly positioned in a first compartment of a refrigeration appliance;

controlling, via an airflow system, a temperature of a second compartment by the further substeps of:

receiving, via a mainboard, a temperature setting for the second compartment;

receiving, via the mainboard, a measured temperature detected by a sensor of the second compartment;

controlling, by the mainboard, a flap of a damper positioned in a first supply duct based on a difference between the temperature setting and the measured temperature;

directing, by the first supply duct coupled to the first compartment and the second compartment, the first air flow directly from the first compartment to the second compartment;

directing, by a first return duct coupled to the first compartment and the second compartment, a second air flow from the second compartment to the evaporator;

providing the temperature as a first temperature;

controlling, by the airflow system, a second temperature of a third compartment by carrying out further steps of:

directing, by a second supply duct coupled to the first compartment and the third compartment, a third air flow from the first compartment to the third compartment; and directing, by a second return duct coupled to the first compartment and the third compartment, a fourth air flow from the third compartment to the evaporator;

providing the airflow system with at least one inner liner panel;

the first supply duct, the second supply duct, the first return duct, and the second return duct being configured to be fastened to the at least one inner liner panel; and the at least one inner liner panel being configured for positioning on a first backside of the first compartment, a second backside of the second compartment, and a third backside of the third compartment.

9. The method according to claim 8, wherein the airflow system contains a housing with a first geometry extending into a first opening of the first supply duct, and controlling the temperature of the second compartment by the further steps of:

distributing, via a fan positioned in the housing, the first air flow through the first geometry to the damper; and controlling, by the mainboard, the flap of the damper positioned in the first supply duct based on a difference between the temperature setting and the measured temperature and causing, via the mainboard, an opening of the flap to allow the first air flow to be directed through the first supply duct to the second compartment.

10. The method according to claim 9, which further comprises controlling, by the mainboard, a speed of the fan positioned in the housing based on the difference between the temperature setting and the measured temperature.

11. The method according to claim 8, wherein the second compartment is configured to operate at a plurality of temperature settings.

12. The method according to claim 11, wherein the plurality of temperature settings includes temperatures ranging from −18 degrees celsius to 4 degrees celsius.

13. An airflow system, comprising:

an evaporator configured to decrease a temperature of air in a first compartment of a refrigeration appliance;

a first supply duct configured for coupling to the first compartment and a second compartment of the refrigeration appliance and configured to direct a first air flow directly from the first compartment to the second compartment;

a damper having a flap, said flap configured to be positioned based on a temperature setting of the second compartment;

a second supply duct configured for coupling to the first compartment and a third compartment of the refrigeration appliance and configured to direct a second air flow from the first compartment to the third compartment;

a first return duct configured for coupling to the first compartment and the second compartment and configured to direct a third air flow from the second compartment to said evaporator;

a second return duct configured for coupling to the first compartment and the third compartment and configured to direct a fourth air flow from the third compartment to said evaporator;

said first supply duct having a first opening formed therein;

a housing having a first geometry extending into said first opening of said first supply duct, said housing configured to receive the air; and a fan configured for positioning in said housing and for distributing the first air flow through said first geometry to said damper positioned in said first opening of said first supply duct;

said flap configured to be in an open position or a closed position;

the open position corresponding to said damper directing the first air flow to the second compartment via said first supply duct, and the closed position corresponding to said damper obstructing said first supply duct; and said housing, said fan, and said evaporator being positioned directly in the first compartment.

* * * * *